US006227422B1

(12) United States Patent
Hansen

(10) Patent No.: US 6,227,422 B1
(45) Date of Patent: May 8, 2001

(54) MOUNTING STRUCTURE FOR NECKTIES

(76) Inventor: Norman F. Hansen, 1766 Marion Ct., Wheaton, IL (US) 60187

( * ) Notice: Subject to any disclaimer, the term of this patent is extended or adjusted under 35 U.S.C. 154(b) by 0 days.

(21) Appl. No.: 09/384,793

(22) Filed: Aug. 27, 1999

(51) Int. Cl.[7] ..... A47G 25/14
(52) U.S. Cl. ..... 223/87; 223/DIG. 1; 223/DIG. 4
(58) Field of Search ..... 223/87, DIG. 1, 223/85, 93, DIG. 4, 91; D6/315

(56) References Cited

U.S. PATENT DOCUMENTS

| | | | | |
|---|---|---|---|---|
| D. 283,466 | | 4/1986 | Megow . | |
| D. 318,378 | | 7/1991 | Baekgasrd, Sr. . | |
| D. 324,785 | | 3/1992 | Kleinke . | |
| D. 368,590 | * | 4/1996 | Charlet | D6/315 |
| 1,754,940 | * | 4/1930 | Freeman | D6/315 |
| 2,264,957 | * | 12/1941 | Shafarman | 223/87 |
| 2,492,226 | * | 12/1949 | Kohl et al. | 223/87 |
| 2,889,934 | | 6/1959 | Vidach . | |
| 3,085,725 | | 4/1963 | Caparosa . | |
| 3,088,597 | | 5/1963 | Ritchey . | |
| 4,023,762 | | 5/1977 | Batts et al. . | |
| 5,421,494 | * | 6/1995 | Kolton et al. | 223/85 |
| 5,526,968 | | 6/1996 | Larson . | |
| 5,826,760 | * | 10/1998 | Kolton et al. | 223/85 |

* cited by examiner

*Primary Examiner*—Bibhu Mohanty
(74) *Attorney, Agent, or Firm*—Meroni & Meroni, P.C.; Charles F. Meroni, Jr.

(57) ABSTRACT

The mounting structure is made of a thin rigid sheet of material, having a first section and a second section. The first section is rearwardly bent and is generally perpendicular to the second section. The first section has an aperture therethrough. The aperture is sized to allow a hook portion of a hanger to be inserted through and disposed within the aperture. The second section has a plurality of channel pairs with each channel in the channel pair extending from an edge of the second section and running relatively parallel across the second section. The channel pair consists of a an upper channel and a lower channel. A necktie or any other similarly shaped article of clothing is held onto the second section by interweaving the necktie between the channel pair so that a portion of the necktie is disposed within both the upper and lower channel. The channel pairs are positioned on the second section so that a plurality of ties can be placed on the mounting structure without having the mounting structure lean to one side or the other.

20 Claims, 4 Drawing Sheets

MOUNTING STRUCTURE FOR NECKTIES

BACKGROUND OF THE INVENTION

1. Field of the Invention

The present invention relates to a mounting structure for hanging and displaying neckties and other similarly shaped articles of clothing such as belts or scarves.

2. Description of the Prior Art

There are a variety of structures currently in the prior art which are designed to carry and display neckties and other similarly shaped articles of clothing. A large majority of these devices are designed to be suspended from clothing racks much like regular hangers. These devices have hooked shaped portions in order to allow them to be suspended on the clothing racks and they are typically designed to hold a plurality of ties.

While there are a variety of devices in the prior art which can be suspended from a clothing rack, there are few devices which are particularly suited to carry and display a plurality of neckties while being suspended from a hanger. The few devices which function with a hanger are typically integrated into the hanger, making them significantly more costly to purchase. There are also devices which can be suspended on a hook portion of the hanger, but these devices typically can hold only one necktie, or if they can hold more, they are often prone to tipping over and releasing the neckties.

In a clothing store environment suits are often displayed with a matching tie in order to encourage customers to purchase the tie as well as the suit. Typically a single tie is attached to a suit in a haphazard fashion with no devices to hold the tie in place. There is a significant benefit to be gained if there was a device which could hold and prominently display a plurality of ties on a suit hung from a hanger.

Also, when people travel with suits, they typically need to bring one or more neckties with the suit. It is particularly important that a device for holding ties which attaches to a hanger be balanced so that the device does not tip over. While transporting the suit, the movement of the hanger will often cause the prior art devices to tip over and release the neckties.

Accordingly, there is a need for an inexpensive device capable of holding and displaying a plurality of neckties and other similarly shaped articles of clothing onto a hanger.

The present invention is a mounting structure for hanging and displaying neckties and other similarly shaped articles of clothing such as belts or scarves.

As will be described in greater detail hereinafter, the present invention solves the aforementioned and employs a number of novel features that render it highly advantageous over the prior art.

SUMMARY OF THE INVENTION

Accordingly it is an object of this invention to provide an inexpensive device capable of holding and displaying a plurality of neckties and other similarly shaped articles of clothing onto a hanger To achieve these objectives, and in accordance with the purposes of the present invention a mounting structure for hanging and displaying neckties and other similarly shaped articles of clothing such as belts or scarves is presented.

The mounting structure is comprised of a thin rigid sheet of material, having a first section and a second section. The first section is rearwardly bent and is generally perpendicular to the second section. The first section has an aperture therethrough. The aperture is sized to allow a hook portion of a hanger to be inserted through and disposed within the aperture. The second section has a plurality of channel pairs with each channel in the channel pair extending from an edge of the second section and running relatively parallel across the second section. The channel pair consists of a an upper channel and a lower channel.

A necktie or any other similarly shaped article of clothing is held onto the second section by interweaving the necktie between the channel pair so that a portion of the necktie is disposed within both the upper and lower channel. The channel pairs are positioned on the second section so that a plurality of ties can be placed on the mounting structure without having the mounting structure lean to one side or the other.

Other objects, features, and advantages of the invention will become more readily apparent upon reference to the following description when taken in conjunction with the accompanying drawings.

DESCRIPTION OF THE PREFERRED EMBODIMENT

Figure 1:
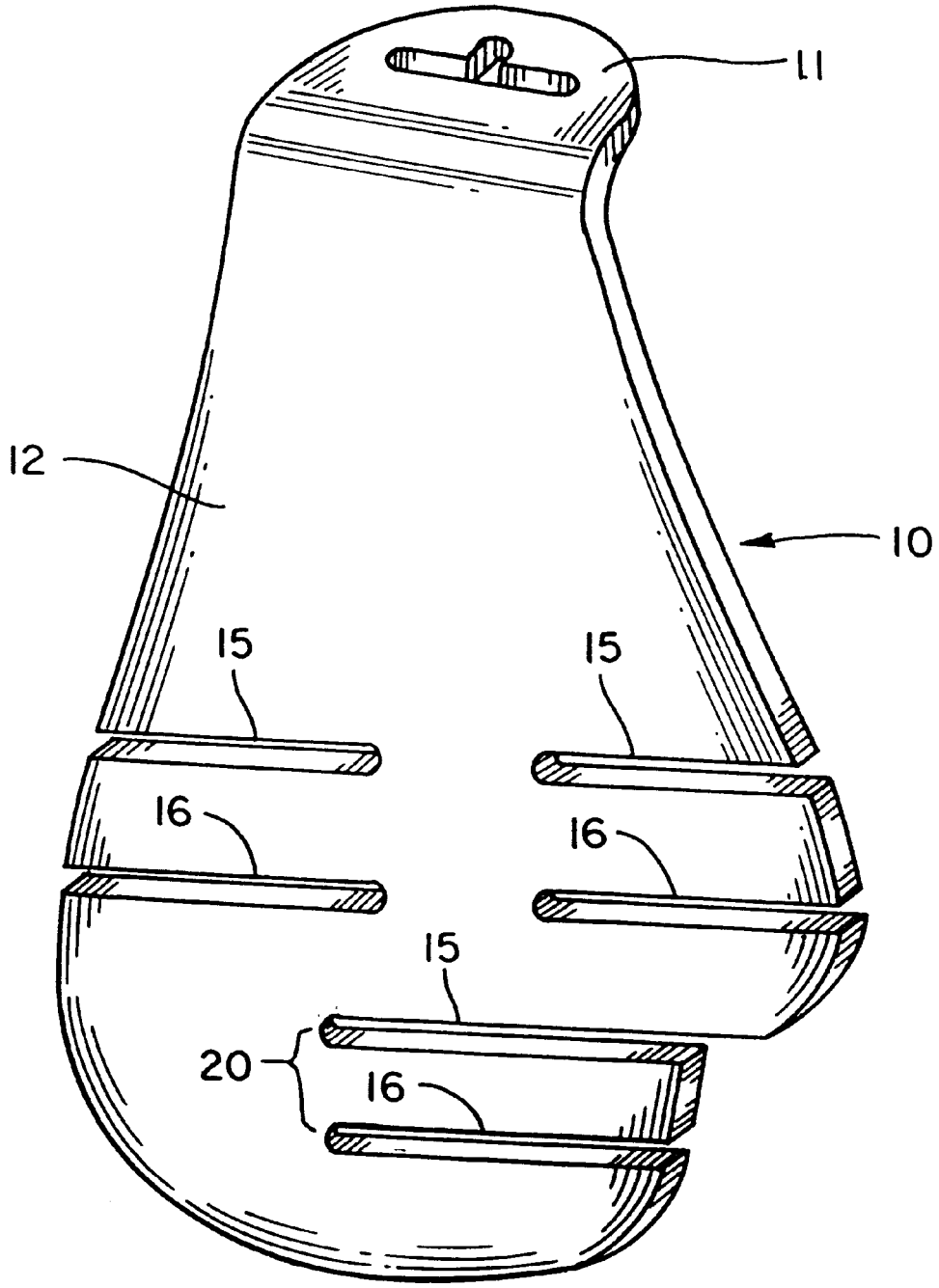
FIG. 1, an isometric view of the mounting structure highlighting features.

Referring to FIG. 1, the present invention is a mounting structure 10 for hanging and displaying neckties and other similarly shaped articles of clothing such as belts or scarves onto a hanger. The mounting structure is comprised of a thin sheet of material, having a first section 11 and a second section 12. In the preferred embodiment, the sheet of material is made of a synthetic plastic, but other materials such as paper may also be used.

Figure 3:
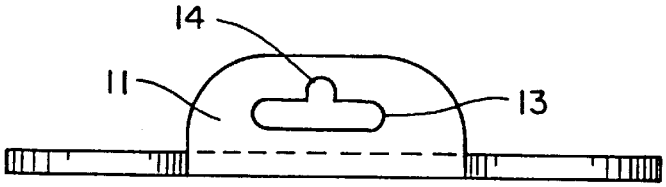
FIG. 3, an overhead planar view of the mounting structure in FIG. 1
Figure 2:
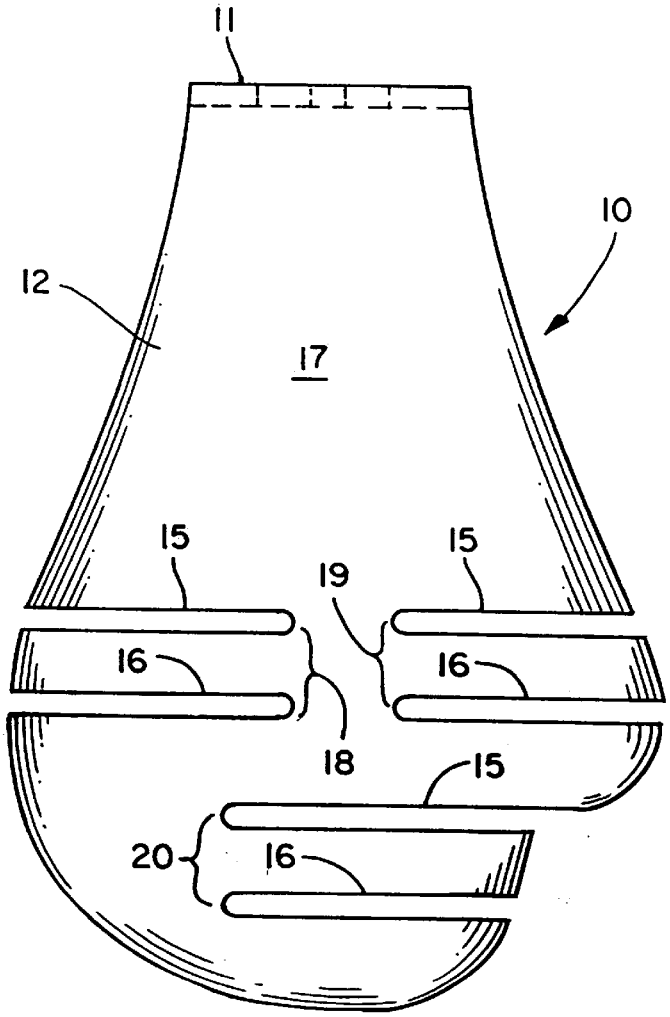
FIG. 2, a front view of the mounting structure in FIG. 1.
Figure 4:
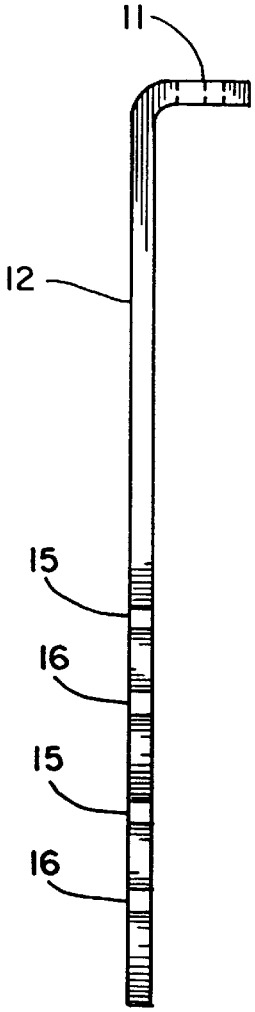
FIG. 4, a side view of the mounting structure in FIG. 1
Figure 5:
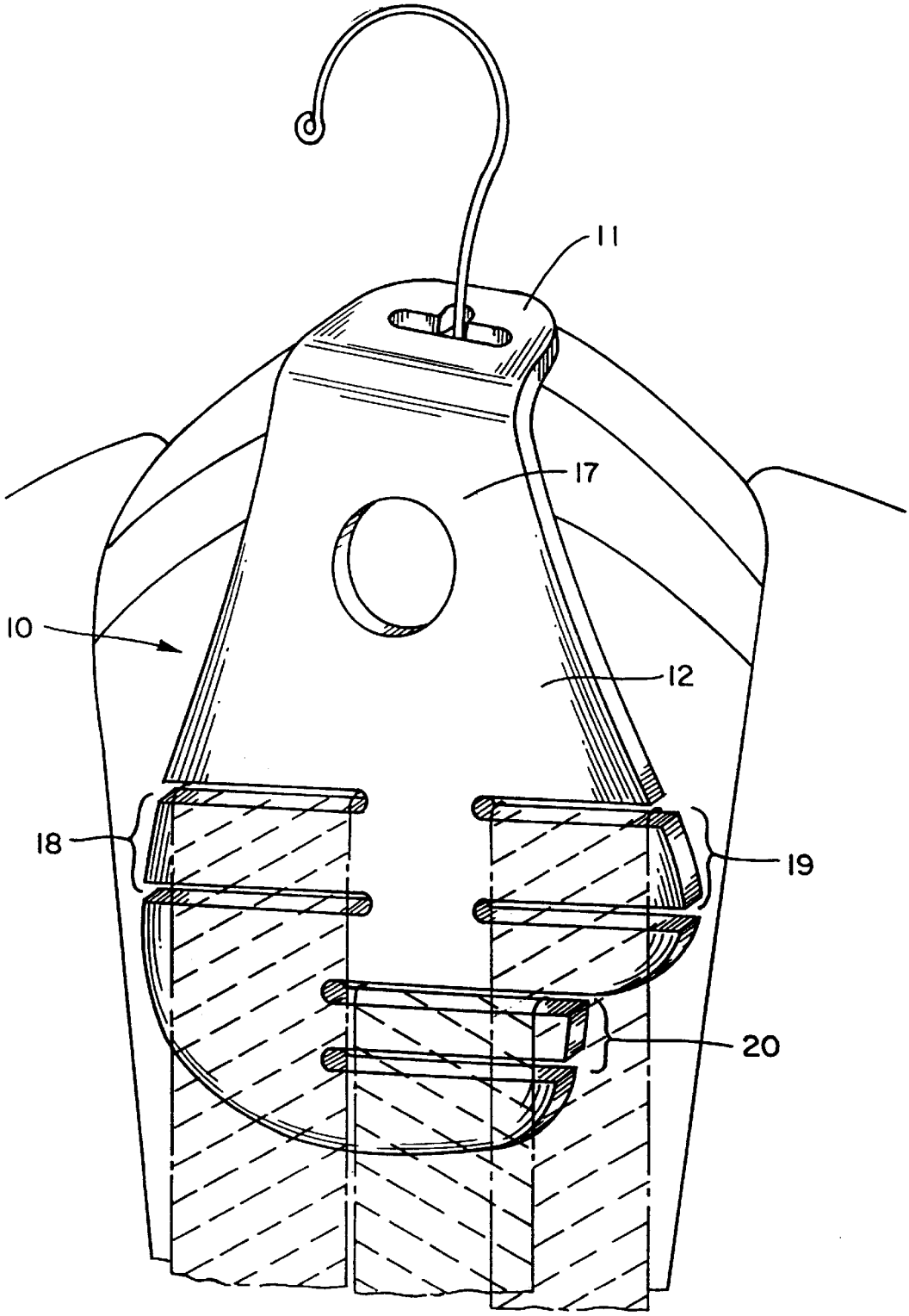
FIG. 5, an isometric view of the mounting structure mounted onto a suit hanger with a suit.
Figure 6:
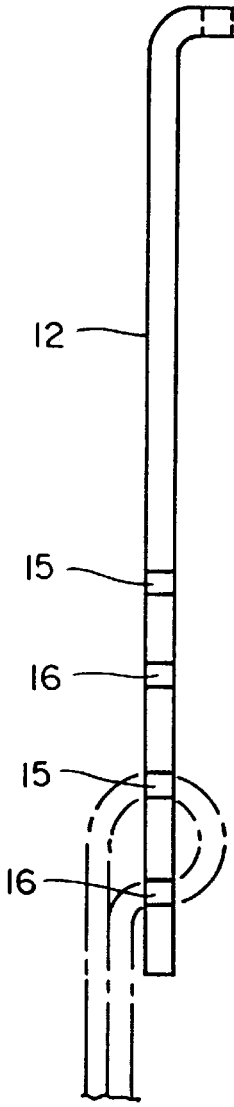
FIG. 6, a side view of the mounting structure in FIG. 1 having a necktie attached thereto.
Figure 7:
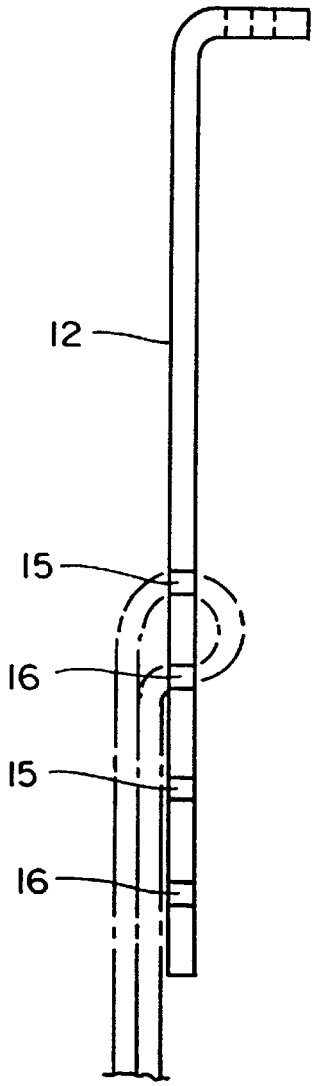
FIG. 7, a side view of the mounting structure in FIG. 1 having two neckties thereto.
Figure 8:
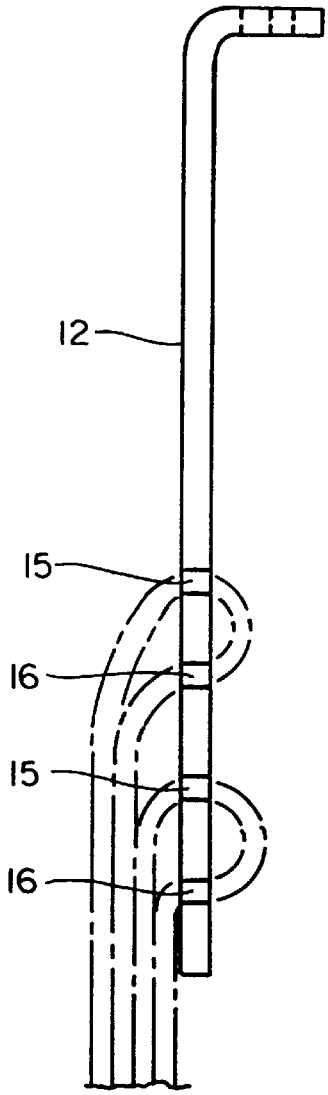
FIG. 8, a side view of the mounting structure in FIG. 1 having three neckties thereto.

Referring to FIGS. 3, 4, 5 the first section 11 is rearwardly bent and is generally perpendicular to the second section 12. When the mounting structure 10 is placed on a hanger, the first section 11 rests primarily on the hanger. The first section provides a sufficient distance between the hanger and the second section to allow the second section to hang relatively parallel to the hanger.

The first section has an aperture 13 therethrough. The aperture 13 is sized to allow a hook portion of a hanger to be inserted and disposed within the aperture 13. In the preferred embodiment, the aperture has a rounded positioning portion 14 which prevents the hook portion of the hanger from sliding laterally in the aperture 13, the positioning portion 14 also serving to align the mounting structure 10 to the hook portion of the hanger.

Referring to FIGS. 2, 5, 6, 7, 8 the second section 12 has a plurality of channel pairs with each channel in the channel pair extending from an edge of the second section and running relatively parallel across the second section. The channel pair consists of a an upper channel 15 and a lower channel 16. In the preferred embodiment, the upper channel is roughly 45 mm long and the bottom channel is 48 mm long. A necktie or any other similarly shaped article of clothing is held onto the second section 12 by interweaving the necktie between the channel pair so that a portion of the necktie is disposed within both the upper 15 and lower 16 channel.

In the preferred embodiment, the second section is rounded forming a tear drop shape. The tear drop shape allows the mounting structure to be positioned at the neck area of a suit coat that is attached to the same hanger as the mounting structure, making the neckties on the mounting structure visible even if a suit coat is attached to the same hanger as the mounting structure. The tear drop shape also provides enough space for a top portion 17 of the second section 12 wherein advertising material may be adhered to or attached.

The second section 12 has a first 18, a second 19, and a third channel pair 20 for hanging a necktie therethrough. The first 18 and second 19 channel pairs are positioned on opposing sides of the second section 12, with the upper 15 and lower 16 channel of each channel pair being essentially collinear to its opposing upper 15 or lower channel 16. The third channel pair 20 is positioned below the first 18 and second 19 channel pairs and centered between the first 18 and second 19 channel pair.

Referring to FIG. 5, the positioning of the first 18, second 19 and third 20 channel pairs forms a balanced orientation allowing one, two or three neckties to be placed on the mounting structure 10 without having the mounting structure 10 lean to one side or the other. If one tie is to be placed on the mounting structure, the tie is placed on the third channel pair and since the third channel pair 20 is centered no lean is produced in the mounting structure. If two ties are placed, then the two ties are placed on the first 18 and second 19 channel pairs, and the symmetry in the location between the first 18 and second 19 channel pairs causes the weights of the two neckties to counterbalance each other preventing the mounting structure 10 from leaning.

It is not intended that the novel device be limited thereby. The preferred embodiment and the second embodiment may be susceptible to modifications and variations that are within the scope and fair meaning of the accompanying claims and drawings.

I claim:

1. A mounting structure for hanging and displaying neckties and other similarly shaped articles of clothing on a hanger, the mounting structure comprising a sheet of material having a rearwardly bent first section and a tear drop-shaped second section, the first section having an aperture with a rounded positioning portion for attaching and aligning the mounting structure to a hook portion of a hanger, the second section having a first, a second, and a third channel pair for hanging a plurality of neckties therethrough, the first, second, and third channel pair positioned on the second portion in a balanced orientation allowing one, two or three neckties to be placed on the mounting structure without having the mounting structure lean to one side or the other, the first channel pair extending from a left edge of the second section, the second channel pair extending from a right edge of the second section in collinear and opposing orientation to the first channel pair, the third channel pair positioned below the first and second channel pairs.

2. The mounting structure in claim 1 wherein the mounting structure is constructed of a synthetic plastic material.

3. The mounting structure in claim 1 wherein a means for mounting advertising material is located on the second section.

4. The mounting structure in claim 1 wherein the first, second and third channel pairs are comprised of an upper channel which is 45 mm long and a lower channel which is 48 mm long.

5. A mounting structure for hanging and displaying neckties and other similarly shaped articles of clothing on a hanger, the mounting structure comprising a sheet of material having a rearwardly bent first section and a second section, the first section having an aperture therethrough for attaching the mounting structure to a hook portion of a hanger, the second section having a plurality of channel pairs for hanging a necktie therethrough.

6. The mounting structure in claim 5 wherein the aperture has a rounded positioning portion for attaching and aligning the mounting structure to a hook portion of a hanger.

7. The mounting structure in claim 5 wherein the second section has a first, a second, and a third channel pair for hanging a necktie therethrough, the first, second, and third channel pair positioned on the second portion in a balanced orientation allowing one, two or three neckties to be placed on the mounting structure without having the mounting structure lean to one side or the other, the first channel pair extending from a left edge of the second section, the second channel pair extending from a right edge of the second section in collinear and opposing orientation to the first channel pair, the third channel pair positioned below the first and second pairs of channels.

8. The mounting structure in claim 5 wherein the mounting structure is constructed of a synthetic plastic material.

9. The mounting structure in claim 5 wherein the second section is tear drop shaped.

10. The mounting structure in claim 5 wherein the second section has a means for mounting advertising material thereto.

11. The mounting structure in claim 5 wherein the channel pairs are comprised of an upper channel which is 45 mm long and a lower channel which is 48 mm long.

12. A mounting structure for hanging and displaying neckties and other similarly shaped articles of clothing on a hanger, the mounting structure comprising a sheet of material having a rearwardly bent first section and a second section, the first section having an aperture for attaching the mounting structure to a hook portion of a hanger, the second section having a first, a second, and a third channel pair for hanging a plurality of neckties therethrough, the first, second, and third channel pair positioned on the second portion in a balanced orientation allowing one, two or three neckties to be placed on the mounting structure without having the mounting structure lean to one side or the other, the first channel pair extending from a left edge of the second section, the second channel pair extending from a right edge of the second section in collinear and opposing orientation to the first channel pair, the third channel pair positioned below the first and second channel pairs.

13. The mounting structure in claim 12 wherein the aperture has a rounded positioning portion for attaching and aligning the mounting structure to a hook portion of a hanger.

14. The mounting structure in claim 12 wherein the mounting structure is constructed of a synthetic plastic material.

15. The mounting structure in claim 12 wherein the second section is tear drop shaped.

16. The mounting structure in claim 12 wherein the second section has a means for mounting advertising material thereto.

17. The mounting structure in claim 12 wherein the channel pairs are comprised of an upper channel which is 45 mm long and a lower channel which is 48 mm long.

18. A mounting structure for hanging and displaying neckties and other similarly shaped articles of clothing on a hanger, the mounting structure comprising a sheet of material having a first section and a tear drop-shaped second section, the first section having a mounting means for attaching and aligning the mounting structure to a hook portion of a hanger, the second section having a plurality of channels for hanging a plurality of neckties therethrough, some of the channels arranged in collinear and opposing orientation one channel extending from a left edge and another channel on a right edge of the second section the remaining channels positioned below and centered in between the channels arranged in collinear and opposing orientation, the channels' positioning creating a balanced orientation on the second section allowing a plurality of neckties to be placed on the mounting structure without having the mounting structure lean to one side or the other.

19. The mounting structure in claim 18 wherein the second section has a means for mounting advertising material thereto.

20. The mounting structure in claim 18 wherein the mounting structure is constructed of a synthetic plastic material.

* * * * *